US005451034A

United States Patent [19]

Ulveling et al.

[11] Patent Number: 5,451,034

[45] Date of Patent: Sep. 19, 1995

[54] DEVICE FOR THE INJECTION OF PULVERIZED COAL INTO A BLAST FURNACE CRUCIBLE

[75] Inventors: Leon Ulveling, Luxembourg-Howard; Yvon Kroemmer, Goetzange; Charles Schmit, Aspelt, all of Luxembourg

[73] Assignee: Paul Wurth S.A., Luxembourg, Luxembourg

[21] Appl. No.: 85,201

[22] Filed: Jun. 30, 1993

[30] Foreign Application Priority Data

Jul. 1, 1992 [LU] Luxembourg ..... 88139
Apr. 21, 1993 [LU] Luxembourg ..... 88249

[51] Int. Cl.[6] ..... C21B 7/16
[52] U.S. Cl. ..... 266/182; 266/221; 266/222; 266/225; 266/267; 266/268; 75/460
[58] Field of Search ..... 266/182, 221, 222, 225, 266/267, 268; 75/460, 461

[56] References Cited

U.S. PATENT DOCUMENTS 3,626,501 12/1969 Baird et al. ..... 266/41

FOREIGN PATENT DOCUMENTS 0390766 10/1990 European Pat. Off. .
2131868 11/1972 France .
4008963 11/1991 Germany .
854991 8/1981 U.S.S.R. ..... 266/267
WO91/14791 10/1991 WIPO .

*Primary Examiner*—Melvyn Andrews
*Attorney, Agent, or Firm*—Fishman, Dionne & Cantor

[57] ABSTRACT

A method and device is provided for the combined injection of pulverized coal and a gaseous oxidant into a crucible of a shaft furnace, especially a blast furnace, through a hot-air blast tuyere. In the region of the nozzle end of the tuyere in the crucible, the pulverized coal is injected into the hot-air blast, in the form of a hollow annular jet and the gaseous oxidant is injected inside the hollow annular jet. A lance for implementing the method comprises two coaxial tubes and a distributing unit provided with a central bore for the pulverized coal.

19 Claims, 6 Drawing Sheets

24
26
18
12
14
32
34
10
30

22'
20'
18
16

28
16
82
80
18
66
64
61
38
60
48
42
36

DEVICE FOR THE INJECTION OF PULVERIZED COAL INTO A BLAST FURNACE CRUCIBLE

BACKGROUND OF THE INVENTION

This invention relates generally to the injection of pulverized coal into a blast-furnace. More particularly, this invention relates to a method and device for the injection of pulverized coal into a blast-furnace crucible encompassing the combined injection of pulverized coal and gaseous oxidant into a blast-furnace crucible by means of a lance emerging in a hot-air blast tuyere. This invention also includes a novel design for a lance and tuyere for implementing this combined injection method.

It is well known that the injection of pulverized coal into the hot-air blast, which is blown through the hot-air blast tuyeres into the upper portion of the crucible of a blast furnace, has many advantages. In particular, it increases the production capacity of the blast furnace and allows significant quantities of coke to be replaced by coal which is far less expensive.

The injection of pulverized coal is performed conventionally by means of an injection lance into the hot-air blast at a certain distance upstream form the nozzle end of the tuyere in the crucible. The pulverized coal is in suspension in an inert gas. The oxidant is either constituted by the hot-air blast, (which may or may not be enriched with oxygen) or by pure oxygen, brought in via a separate pipe close to the nozzle end of the lance. In the latter case, pure oxygen is used to form a primary fuel mixture with the pulverized coal at the outlet of the lance, and the hot-air blast constituting the secondary combustion air.

From the specification of German Patent DE-4,008,963 C1, a method is known for the combined injection of pulverized coal and oxygen into a blast-furnace crucible by means of a lance emerging with one end in a hot-air blast tuyere. The lance body comprises an inner tube for the pulverized coal and an outer tube forming, with the aforementioned inner tube, an annular conduit for the oxygen. According to the method disclosed in the abovementioned patent specification, the jet of pulverized coal is directly surrounded at its periphery by an annular jet of oxygen. Although this method is satisfactory at low flow rates, problems do occur when greater quantities of pulverized coal are introduced into the crucible.

One problem is that in order to work efficiently during the injection of pulverized coal into a blast furnace, it is necessary to produce as complete a combustion of the coal as possible in the turbulent zone in the immediate vicinity of the nozzle end of the tuyere in the crucible. When combustion does not take place sufficiently or rapidly enough before or in this zone, (which is the case when working with high flow rates of pulverized coal in a tuyere) large quantities of powdery residues from the combustion accumulate in the blast furnace and in the furnace filters. These residues considerably increase the resistance to the flow of the hot gases.

The difficulty in obtaining a complete combustion in the turbulent zone is due, on the one hand, to the short distance available and, on the other hand, to the high speed of the hot-air blast in the tuyere. During the extremely short time available for the combustion of carbon particles at the outlet of the lance, the following events must take place; (1) the compact jet of pulverized coal in suspension in a neutral gas must be broken up, (2) the isolated coal particles have to be reheated until the release of pyrolysis gases has taken place, (3) the pyrolysis gases have to be mixed with the fuel, (4) the ignition of this gaseous mixture has to take place and (5) the solid residues of the pyrolysis have to react with the oxidant in a heterogeneous oxidation reaction. One of the major problems of the injection of pulverized coal into the crucible is therefore to increase the kinetics of the execution of these combustion mechanisms described very briefly hereinabove.

It is obvious that there is a need for an improved and/or novel method for the combined injection of pulverized coal and a gaseous oxidant into a blast-furnace crucible, by means of a lance emerging in a hot-air blast tuyere, which would enable the yield of the combustion to be significantly improved. This is especially needed when working with high flow rates of pulverized coal which is desirable because of the much lower cost of the coal over coke.

SUMMARY OF THE INVENTION

The above-discussed and other problems and deficiencies of the prior art are overcome or alleviated by the method and device for the injection of pulverized coal into a blast-furnace crucible of the present invention. In accordance with the present invention, the pulverized coal is injected into the hot-air blast in the region of the nozzle end of the tuyere in the crucible in the form of a hollow annular jet and the gaseous oxidant is injected inside the same hollow annular jet of pulverized coal.

In accordance with the present invention, the pulverized coal is, therefore, no longer injected in the form of a solid compact jet, but rather in the form of a hollow annular jet. This way of proceeding has the direct advantage that the jet is more easily broken up into isolated particles than a solid compact jet transporting the same flow rate of pulverized coal. In addition, the external surface of the jet is increased, while the thickness of the jet is decreased, which exposes the isolated coal particles more directly to the radiation.

The gaseous oxidant, for example oxygen, is no longer injected around the jet of pulverized coal, but, instead, is introduced directly into the hollow of the annular jet of pulverized coal. This way of proceeding has many advantages. Firstly, the oxidant no longer constitutes a cold screen between the hot-air blast and the jet of pulverized coal. Secondly, it should be noted that the annular jet of pulverized coal has its external surface exposed to the hot-air blast and its internal surface exposed to the gaseous oxidant. The coal particles in the annular jet are consequently contained in a thin layer sandwiched between two oxidant streams, which has a positive effect on the rapid formation of an inflammable mixture. Finally, it should be noted that, under the influence of a large heat influx, due to the high temperatures prevailing in the crucible, the oxidant gas introduced into the hollow of the jet of pulverized coal undergoes an ultra-rapid expansion which literally causes the hollow annular jet of pulverized coal to explode from the inside. This explosion projects and disperses the oxidant, the hot-air blast and the fuel, forming an ideal turbulent mixture in the zone of I the crucible in the vicinity of the tuyere where spontaneous combustion takes place.

All the aforementioned phenomena are mutually sustained in order to dramatically and unexpectedly increase the combustion yield when introducing pulverized coal through the hot-air blast tuyere into a blast-furnace crucible in accordance with the present invention. Now, given that the combustion yield is markedly improved, it is possible to work with much higher flow rates of pulverized coal, without running the risk of clogging the filters of the hot-gas circuit of the blast furnace. It is consequently possible to replace large quantities of coke by coal which is considerably less expensive.

In addition, the method and device in accordance with the present invention allows the injection of the pulverized coal and the gaseous oxidant to be performed in the region of the nozzle end of the tuyere in the crucible. It should be recalled that hitherto the injection of pulverized coal had to be performed at a certain distance upstream of the nozzle end, to increase the path available for the execution of the combustion mechanism. Now, with the present invention, the breaking up of the coal jet takes place virtually immediately at the outlet of the tuyere. It follows that the path necessary for the execution of the combustion mechanism is extremely short, and that an injection lance may virtually penetrate into the crucible without decreasing the combustion yield.

A direct advantage of this shortened path is that the hot-air blast conduit of the tuyere is less stressed from a thermal point of view. In addition, hot ashes are virtually excluded from sticking on the cold walls of the tuyere, which not only has a beneficial affect on the lifetime of the tuyere, but also prevents clogging of the hot-air blast pipe by the ashes. The injection of the pulverized coal and the oxidant in the region of the nozzle end of the tuyere in the crucible consequently makes it possible to increase the lifetime of the tuyeres without decreasing the combustion yield.

In accordance with the present invention, a lance for implementing the method is provided. This lance comprises, in a lance body, separate conduits for the pulverized coal and the gaseous oxidant. The lance body has, in its end emerging in the hot-air blast tuyere, an injection nozzle for the pulverized coal arranged annually around an injection nozzle for the oxidant gas. The lance body comprises an inner tube forming an inner conduit for the gaseous oxidant and an outer tube surrounding the inner tube, so as to define, with the inner tube, an annular conduit for the pulverized coal.

This embodiment of the lance permits a particularly straightforward production of the annular nozzle for injecting the pulverized coal surrounding the nozzle for injecting the gaseous oxidant. It will be appreciated that the flow of the pulverized coal in the lance body is a rectilinear flow, which is not subjected to any major deviation. In this context, it should be pointed that the pulverized coal has significant abrasive power, and that any wall causing a deviation of the flow path is subjected to significant wear. Now, Such wear in the region of a wall of the lance body could possibly lead to a sudden rupture in this wall with imminent danger of complete destruction of the lance and of the hot-air blast conduit.

A device for coupling the lance body to a circuit for supplying pulverized coal in suspension in an inert gas and to a circuit for supplying a gaseous oxidant, for example oxygen, is preferably located on the outside of the hot-air conduit. This device is then fitted onto that end of the lance body which is opposite the end emerging in the tuyere, which permits easy introduction of the body of the lance through a sleeve penetrating into the hot-air blast conduit.

In accordance with the present invention, a coupling device to prevent wear by the abrasive flow of pulverized coal comprises splitting the flow of the pulverized coal into a plurality of pulverized coal channels connected to the annular conduit. The gaseous oxidant is caused to pass through the channels which are connected to the inner conduit which channels are arranged between the pulverized-coal channels. The coupling device, therefore, includes first channels connecting the first coupling sleeve to the annular pulverized coal conduit; and second channels which are arranged between the first channels in order to connect the second coupling sleeve to the inner oxidant conduit. In this manner, the gaseous oxidant channels do not have to pass through the flow of pulverized coal and therefore are not subjected to wear by this highly abrasive flow.

The coupling device comprises a distributing unit provided with two opposed faces, the lance body emerging through one of the faces and the first coupling sleeve emerging in the axial extension of the lance body through the opposite surface into the distributing unit. The distributing unit is provided with a central blind bore axially extending the inner conduit and with an annular cavity axially extending the annular conduit. At least two first channels are arranged symmetrically around the central bore and emerge on the one side in the annular cavity and on the other side in the first coupling sleeve, with at least one second channel arranged between the first channels connecting the central bore to the second coupling sleeve. It will be appreciated that this embodiment of the coupling device is particularly compact while still having a design which prevents any wear by the abrasive flow of the pulverized coal. The pulverized coal is introduced virtually axially into the annular conduit of the lance, in a flow having a symmetry of revolution, without imparting to the pulverized coal significant changes of direction.

To further improve the uniformity of the supply of pulverized coal to the annular conduit, the annular cavity axially extending the annular conduit in the distributing unit has a cross-section which decreases steadily from the nozzle end of the first channels in the direction of the nozzle end of the annular conduit. This embodiment also prevents any discontinuity in the internal walls of the distributing unit.

In this embodiment, the supply of gaseous oxidant, comprises an annular peripheral chamber into which emerge a plurality of second channels distributed around the central channel. This arrangement has the advantage of reducing the head loss of the flow of the gaseous oxidant in the region of the coupling device.

The coupling device is composed of two half-units joined axially by means of screws. The inner tube is thus fixed to the first half-unit and the outer tube to the second half-unit. This embodiment has the advantage of being composed of easily producible parts and permits easy fitting and dismantling of the inner conduit in the coupling device. The outer conduit is provided with a flange which is fastened by means of screws onto the second half-unit.

An alternative embodiment of the lance in accordance with the present invention comprises the following elements. (1) Similarly to the preferred embodiment, a lance body emerges with one end of the lance in a hot-air blast tuyere of a crucible of a shaft furnace, especially a blast furnace. The lance body encompasses an inner tube forming an inner conduit for the gaseous oxidant and an outer tube surrounding the inner tube so as to define, with the latter, an annular conduit for the pulverized coal. (2) A distributing device connecting the inner tube to a supply circuit for the gaseous oxidant and also connecting the annular conduit to a supply circuit for the pulverized coal. (3) Means to electrically insulate the inner tube from the outer tube. (4) Means to apply a potential difference between the outer tube and the inner tube to create an electrical field in the annular channel.

The main advantage of this alternative embodiment is to be able to subject (simply and effectively) the flux of pulverized coal to the action of an electrical field. This approach has a favorable influence on the kinetics of the combustion at the outlet of the lance, in particular, the formation of a reactive mixture between the coal particles (which are in suspension in an inert gas) and the oxidant gas. It will be noted that the length of this electrical field can be equal to the length of the lance body.

The distributing device of this alternative embodiment comprises a distributing unit made of a hard dielectric material, which is very resistant to wear by the pulverized coal. For example, this is preferably a ceramic material, especially a ceramic material based on aluminum oxide. By virtue of the fact that this distributing unit is made of dielectric material, it is possible to simply and effectively solve the problems of electrical insulation between the outer tube and the inner tube of the lance body.

This distributing unit is preferably a prismatic unit having a first and a second base and a plurality of lateral surfaces. The unit is provided with the following elements.

(1) A blind central bore in the first base in order to receive one end of the inner tube.
(2) A cavity emerging in the second base.
(3) Channels surrounding the central bore and extending the cavity in order to emerge in the first base.
(4) A first lateral bore located between the channels, so as to define a nozzle end in a first lateral surface and to emerge in the central bore.
(5) A second lateral bore located between the channels and defining a nozzle end in a second lateral surface and emerging in the central bore.

This is a particularly simple embodiment, which makes it possible to bring the oxidant gas in the inner tube and the pulverized coal in the outer tube, without running the risk of either erosion of the oxidant-gas pipes by the flux of pulverized coal or an electrical short-circuit.

In order to make the various connections to the dielectric prismatic unit simply and effectively, the distributing device comprises the following elements:

(1) A First front plate which bears on the second base of the prismatic unit and which supports, in the extension of the cavity, a coupling sleeve for the pulverized coal.
(2) A forward half-unit which supports the outer tube and which bears on the first base of the prismatic unit.
(3) A first lateral plate which bears on the first lateral surface of the prismatic unit and which supports, in the extension of the first lateral bore, a coupling sleeve for the gaseous oxidant.
(4) A second lateral plate which bears on the second lateral surface of the prismatic unit and which supports, in the extension of the second lateral bore, an electrode penetrating through the lateral bore into the central bore.

In order to join the prismatic unit and the forward half-unit, which supports the outer tube, the distributing unit comprises bolts which connect the forward half-unit to the first front plate. The inner tube is provided with a flange which is housed axially between the distributing unit and the forward half-unit and which is locked therein by the axial joining of the distributing unit and the forward half-unit. This flange constitutes a simple and effective method for fastening the inner tube to the coupling device and enables, at the same time, the blind hole to be sealed around the inner tube.

The forward half-unit is provided with a recess which flares out from the nozzle end of the outer tube in the direction of the distributing unit. The surface which delimits the recess is preferably a curve which is defined by a conical section and which is tangential to the internal surface of the outer tube. The inner tube is thus provided, in the region of its nozzle end in the distributing unit, with a sleeve having substantially the shape of a bottleneck which, after joining the lance, is positioned in the recess of the forward half-unit so as to define an annular channel which emerges virtually tangentially in the annular conduit of the lance body. This is an embodiment which substantially reduces erosion by the pulverized coal in the region of the passage of the dielectric unit into the annular channel of the lance body. In addition, it ensures good distribution of the flux of pulverized coal in the annular channel of the lance body.

It will be noted that, in all the embodiments of the lance, the inner tube is provided, in the region of its outlet nozzle, with a deflector designed so as to promote a radial explosion of the jet of gaseous oxidant at the outlet of the lance. This deflector comprises, for example, a helical element integrated in the injection nozzle formed by the inner tube.

An additional feature of the present invention is to provide simply and with complete safety a method and device to introduce the injection lance into the hot-air blast conduit as far as the region of the nozzle end of the tuyere in the crucible. In this context it should be recalled that hitherto the introduction of the lance was performed through a conduit disposed upstream of the tuyere. This conduit, which is called a blast pipe, forms, with its snout, a ball-and-socket joint on the tuyere so as to permit relative angular movement between the tuyere and the blast pipe resulting from thermal stresses in the hot-air blast conduit system. Now, if it is desired to penetrate through the blast pipe with the lance head as far as the region of the nozzle end of the tuyere, it is necessary to choose a very small angle between the axis of the lance and the axis of the blast pipe. It follows that the protruding length of lance in the hot-air blast conduit is long and that the centering of the lance head in the tuyere becomes difficult, uncertain and unstable, the more so as there is the possibility of relative movement between the tuyere and the blast pipe. Now, a misalignment of the end of the lance in the tuyere inevitably ruins the tuyere when the jet of pulverized coal strikes the wall delimiting the hot-air blast conduit head-on. It therefore will be keenly appreciated that the present invention provides a solution which does not have any of aforementioned disadvantages. The lance is introduced through a channel made in a double wall which defines the hot-air blast conduit of a tuyere. This arrangement of the lance makes it possible to ensure precise and reliable adjustment of the lance head in the hot-air blast conduit, in the region of the nozzle end of the tuyere in the blast-furnace crucible.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figures 1, 1A, 2:
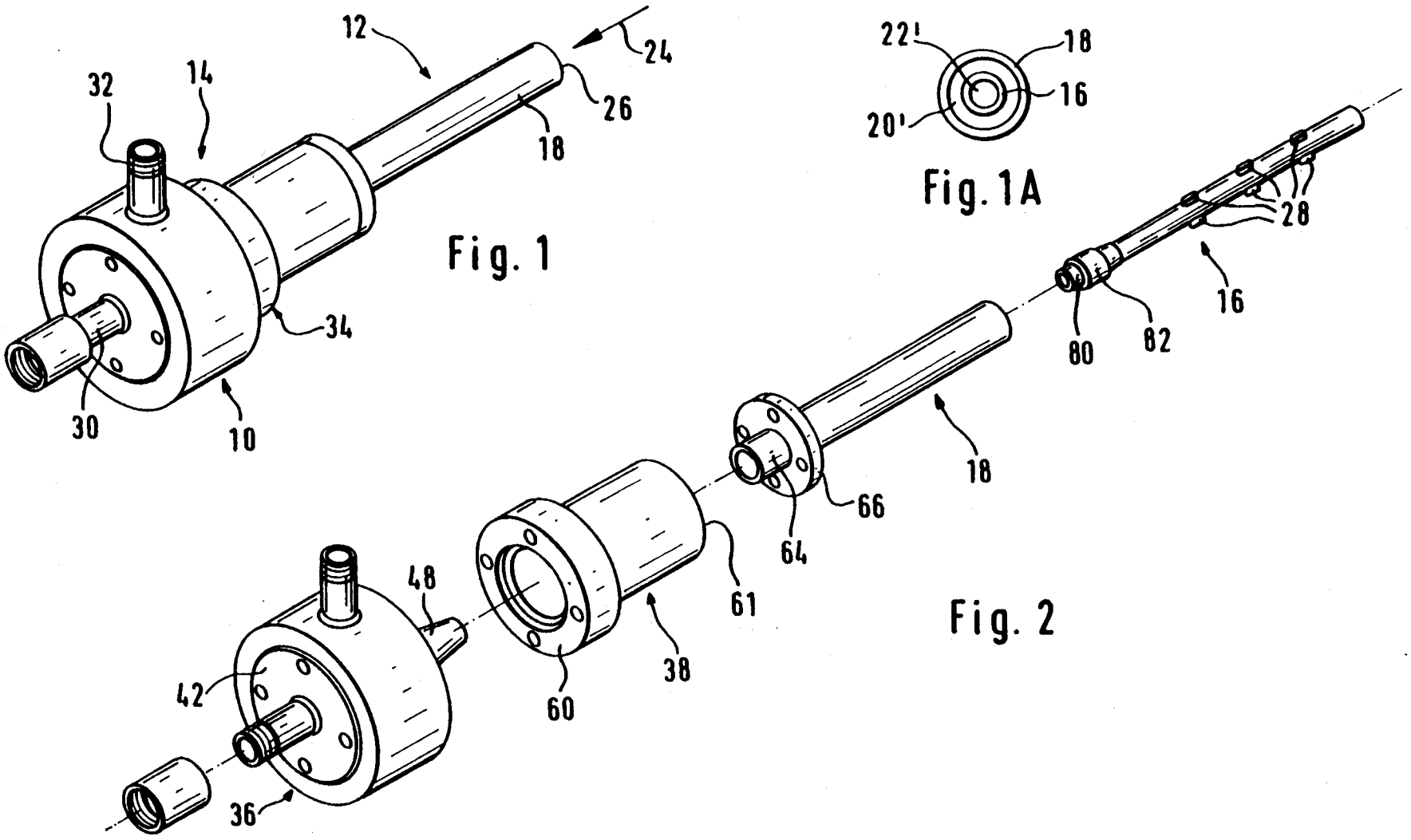
FIG. 1 is a perspective view of a preferred embodiment of an injection lance in accordance with the present invention.
FIG. 1A represents a front view of the injection nozzles of the lance device of FIG. 1.
FIG. 2 represents an exploded view of the lance of to FIG. 1.

A preferred embodiment of the lance device used to implement the method in accordance with the present invention is described with the aid of FIGS. 1 to 4. Lance 10 is principally composed of an oblong lance body 12 which is fixed with one of its ends to a coupling device 14. Coupling device 14 serves to connect the lance 10 to a circuit for supplying the pulverized coal in suspension in an inert gas and a circuit for supplying a gaseous oxidant. The gaseous oxidant may, for example, be oxygen.

The lance body is composed of a double conduit (20,22) formed by an inner tube 16 and an outer tube 18. The tube 16, which has a smaller cross-section than the tube 18, is introduced axially into the tube 18 so as to define an annular conduit 20 between the two tubes 16 and 18. This annular conduit 20 is intended for the passage of the pulverized coal, whereas the first tube 16 itself defines a cylindrical conduit 22 which is intended for the passage of the gaseous oxidant.

FIG. 1A shows a front view of the lance body 12 in the direction of the arrow 24 of FIG. 1. It may be seen that the lance body 12 defines, at its free end 26 a double nozzle end. The double nozzle end comprises an annular injection nozzle 20', in which the annular conduit 20 terminates, and a circular injection nozzle 22', in which the cylindrical conduit 22 terminates. The injection nozzle 20' for the pulverized coal is especially disposed annularly around the injection nozzle 22' for the gaseous oxidant. With this lance 10 it is possible to produce a hollow annular jet of pulverized coal and to introduce the gaseous oxidant on the inside of the hollow annular jet, in complete conformity with the method in accordance with the present invention.

FIG. 2 shows that the tube 16 is provided with spacing pieces 28 which ensure radial spacing of the outer tube 18 in relation to the inner tube 16. Since these spacing pieces are exposed to the flow of pulverized coal, they are preferably produced in a hard material which is virtually impervious to abrasion.

Figure 3:
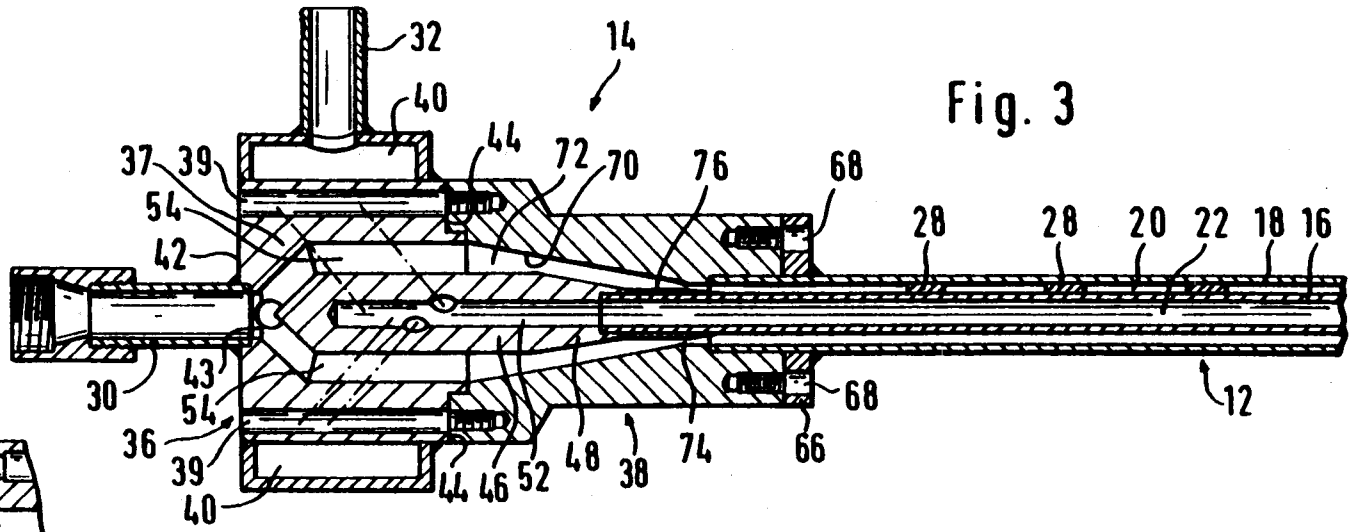
FIG. 3 represents a longitudinal cross-section of the lance device of FIG. 1.

The coupling device 14 comprises a first coupling sleeve 30 for the pulverized coal and a second connector 32 for the gaseous oxidant. The two connectors 30 and 32, and likewise the lance body 12, are fitted onto a distributing unit 34 preferably composed of two half-units 36 and 38 which are joined in the extension of the axis of the body of the lance 12 by means of screws. FIG. 3 shows two bores 39, intended to receive these screws, which extend from the half-unit 36 into the half-unit 38.

The half-unit 36 comprises a solid cylindrical body 37, surrounded by a peripheral annular chamber 40, in which the second coupling sleeve 32 for the gaseous oxidant terminates. The first coupling sleeve 30 terminates axially through a base 42 in a cavity 43 of the cylindrical body 37. On the side where the opposite base 44 is located, the cylindrical body 37 possesses a cylindrical axial extension 46 of substantially smaller diameter than the solid cylindrical body 37 and which is terminated by a frustoconical portion 48. At its base, the axial extension 46 is surrounded by an end-piece 50, so that the base 44 of the cylindrical body 37 is reduced to a plane annular ring 44 surrounding the end-piece 50.

A central blind bore 52 extends axially from the end of the frustoconical portion 48 right into the solid cylindrical body 37. This central bore 52 has substantially the same internal diameter as the tube 16. Around this central bore 52, in the solid cylindrical body 37, extend first channels 54 which emerge in the annular surface defined by the end-piece 50 around the axial extension 46. On the side where the base 42 of the cylindrical body 37 is located, these channels 54 are extended in the axial cavity 43, in which the sleeve 30 terminates. The channels 54 are preferably disposed symmetrically around the blind bore 52. In the preferred embodiment represented in the figures, there are four channels 54 in all, each spaced 90° apart.

Figure 3A:
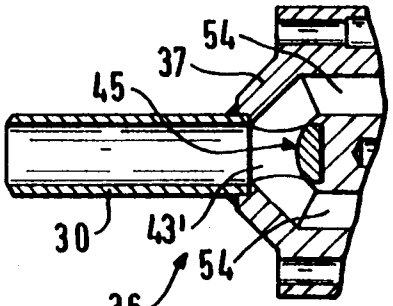
FIG. 3A shows a cross-section of an alternative embodiment of a detail of the device of FIG. 3.

FIG. 3A shows an alternative embodiment of the nozzle end of the coupling sleeve 30 in the body 37. The volume of the cavity 43' is significantly increased in relation to the volume of the cavity 43. Facing the nozzle end of the coupling sleeve 30 in this cavity 43', the body 37 is provided with a deflection surface 45 made of a material which is highly resistant to erosion by the pulverized coal. This deflection surface 45 may form part of an attached part, may consist of an added material or may be obtained by a suitable surface treatment. It is preferably rounded in order to prevent catching of the fibrous matter contained in the pulverized coal.

Figure 4:
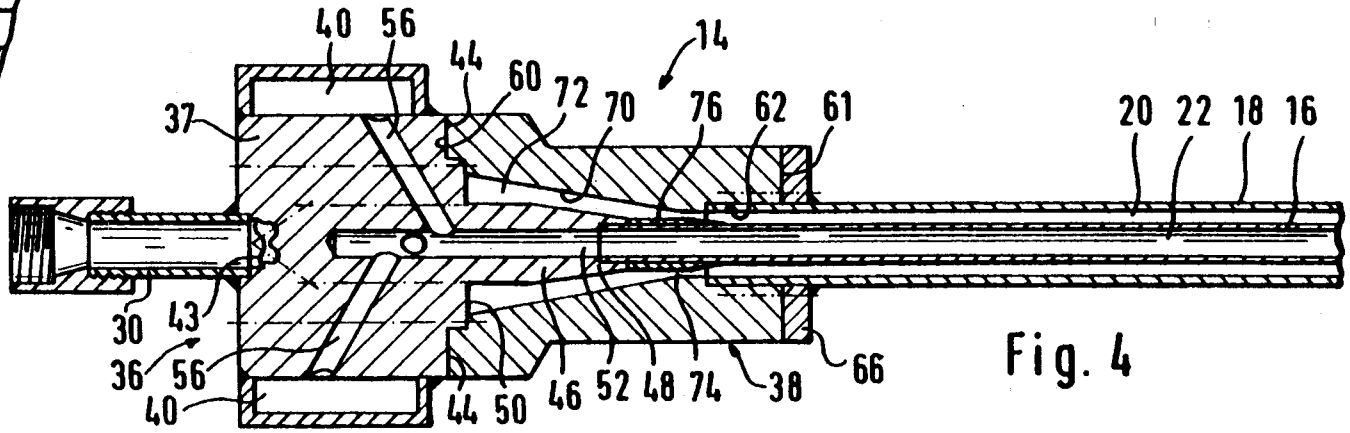
FIG. 4 represents a longitudinal cross-section of the lance device of FIG. 1, in a cutting plane making an angle of 45° with the cutting plane of FIG. 3.

FIG. 3 shows a longitudinal cross-section through the coupling device 14 through a plane passing through two of the four channels 54. By contrast, FIG. 4 represents a longitudinal cross-section through a plane making an angle of 45° with the cutting plane of FIG. 3. It may be seen that, in FIG. 4, the solid cylindrical body 37 is provided, in this plane, with two second channels 56 which extend from the central bore 52 towards the peripheral annular chamber 40 in which they emerge. A further two of these second channels are located in a plane making an angle of 90° with the cutting plane of FIG. 4.

The half-unit 38 constitutes a cylindrical sleeve which bears, with an annular base 60, on the annular base 44 of the half-unit 36. A cylindrical bore 62, having an internal diameter equal to the external diameter of the tube 18, axially terminates in the opposite base 61 of the sleeve. This bore 62 serves as a seat at the end 64 of the tube 18, which is rigidly attached to a flange 66. The flange 66, which is, for example, welded to the tube 18, may be fixed with the aid of screws to the sleeve 38 on the side of its base 61. FIG. 3 shows two of the bores 68 provided for these screws. It will be appreciated that the outer tube 18 may thus be replaced very easily, without dismantling the coupling device 14 or the inner tube 16.

The outer tube 18 emerges in a frustoconical bore 70 which extends axially, flaring out, through the half-unit 38 in order to terminate at the center of the annular base 60. The small base of this frustoconical bore 70 corresponds to the passage cross-section of the tube 18, whereas the large base has a diameter which is equal to the diameter of a circumference in which are inscribed all the nozzle ends of the channels 54 on the side where the end-piece 50 is located.

By joining the two half-units 36 and 38, the frustoconical bore 70 of the half-unit 38 cooperates with the coaxial extension 46, 48 of the half-unit 36 in order to define an annular cavity 72. The annular cavity 72 consequently surrounds the central bore 52 over a portion of the length of the central bore 52 in order to extend the annular conduit 20 axially in the direction of the nozzle ends of the channels 54. It will be noted that the free surface area of the annular transverse cross-section of the annular cavity 72 decreases steadily in the direction of the nozzle end of the annular conduit 20, in order to form a neck 74 just before it penetrates into the annular conduit 20. In this fashion, the distribution of the coal in the annular conduit 20 is rendered uniform.

The inner tube 16 is fitted with its end 80 axially in the frustoconical portion 48 of the half-unit 36. This fitting of the inner tube 16 is performed, for example by brazing, before joining the two half-units 36 and 38.

It will be noted that a sleeve 76 has been provided in the region of the neck 74, that is to say at the place where the flow of pulverized coal comes into contact with the inner tube 16. This sleeve may be fixed by brazing to the frustoconical portion 48. Made from a more wear-resistant material, it effectively protects the inner tube 16 from wear by abrasion, due to a slight deviation of the annular flow at the junction between the annular cavity 72 and the annular conduit 20.

Figure 7:
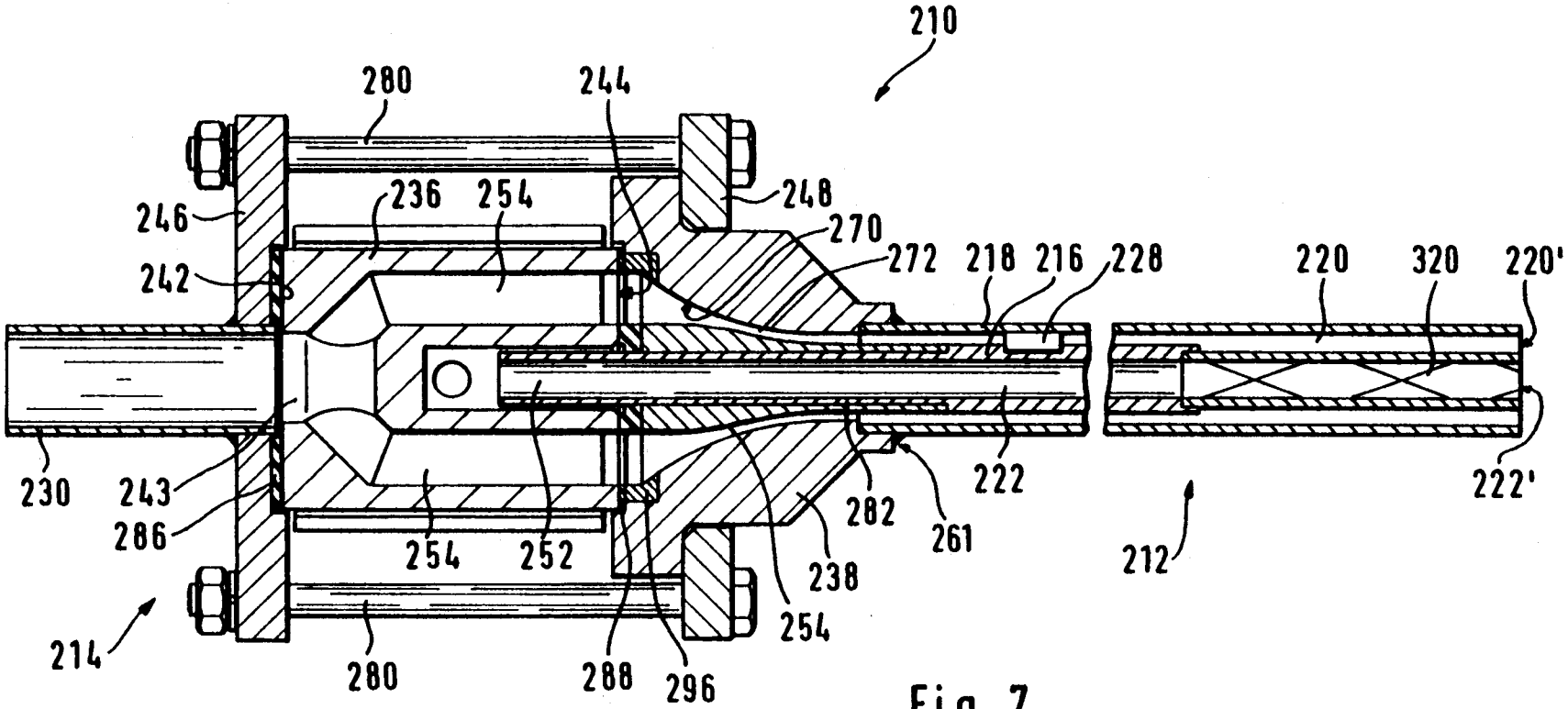
FIG. 7 represents a longitudinal cross-section of an injection lance in accordance with the present invention which enables the pulverized coal in the lance to be subjected to an electrical field.
Figure 8:
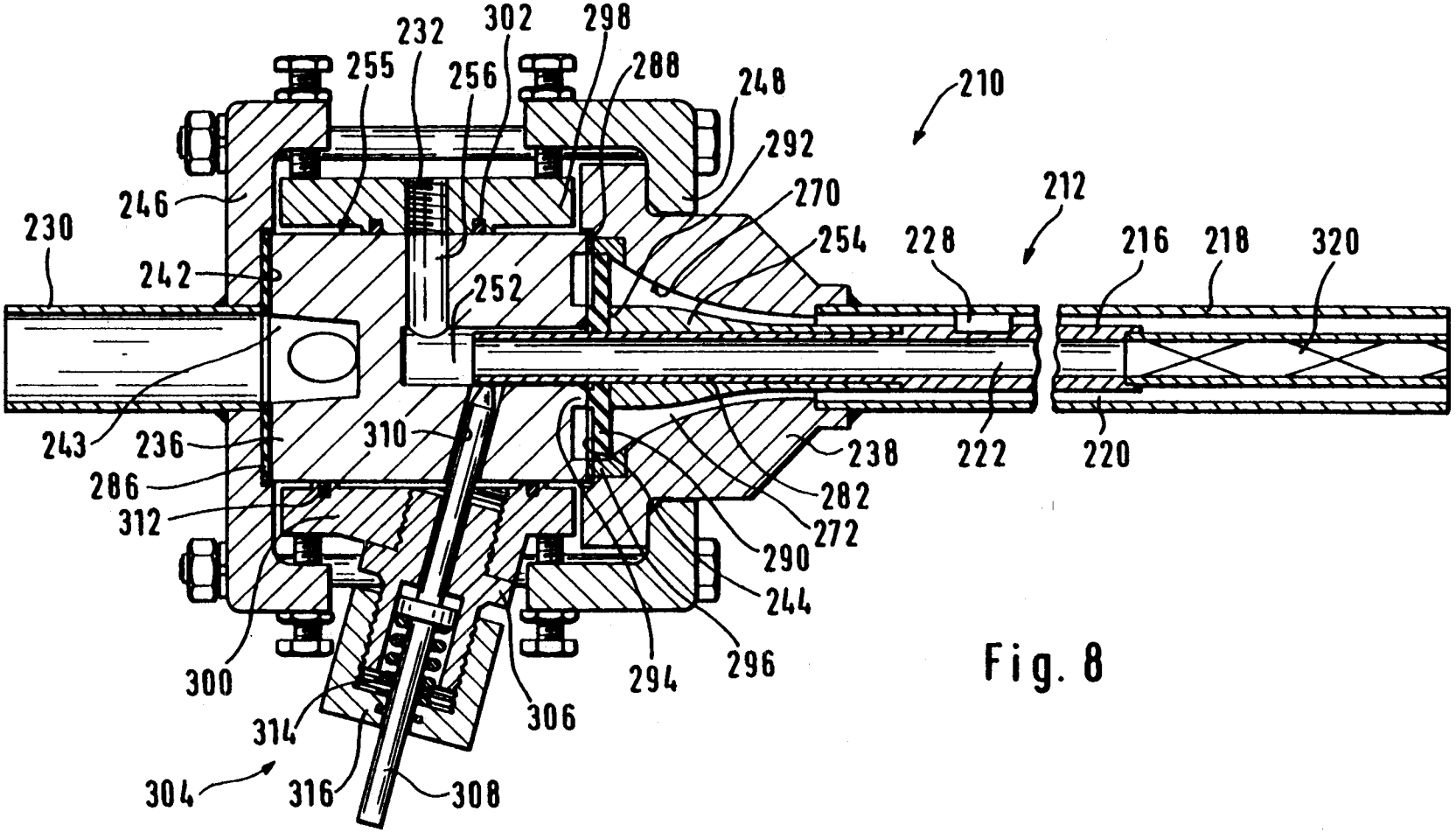
FIG. 8 represents a cross-section through the injection lance of FIG. 7, through a cutting plane making an angle of 90° with the cutting plane of FIG. 7.

FIGS. 7 and 8 show a second embodiment of a lance used to implement the method in accordance with the present invention. This lance 210 comprises a lance body 212 which is fixed with one of its ends to a coupling device 214. The lance body is composed of a double conduit 220,222, which is formed by an inner tube 216 and an outer tube 218. The tube 216, which has a smaller cross-section than the tube 218, is introduced axially into the tube 218 so as to define an annular conduit 220 between the two tubes 216 and 218. This annular conduit 220 is intended for the passage of the pulverized coal, whereas the first tube 216 itself defines a cylindrical conduit 222 which is intended for the passage of the gaseous oxidant.

A particular feature of the lance 210 shown in FIGS. 7 and 8 is that it is designed for the application of a potential difference between the two tubes 216 and 218. In other words, the lance 210 is designed to create, in the annular conduit 220, an electrical field which makes it possible to charge the coal particles which are delivered, in suspension in an inert gas, through the annular conduit 220. The two tubes 216 and 218 are made of a material which is a good conductor of electricity and are spaced apart by spacing parts 228 made of a dielectric material, for example a ceramic material based on aluminum oxide. The outer surface of the inner tube 216 may also be provided with a dielectric coating, for example a ceramic coating based on aluminum oxide, which has at the same time a high resistance to wear by the pulverized coal.

The coupling device 214 is specially designed to fulfill its triple role, namely:

1) to connect the annular conduit 220 to a coupling sleeve 230 for the pulverized coal;
2) to connect the inner conduit 222 to a coupling sleeve 232 for the oxidant gas;
3) to connect a potential difference between the outer tube 218 and the inner tube 216.

For this purpose, the coupling device 214 comprises a distributing unit 236, in which the two coupling sleeves 230 and 232 emerge, and a forward half-unit, through which the lance body 212 emerges. The two parts 236 and 238 are joined axially between two front plates 246 and 248. Front plates 246 and 248 are connected via bolts 280 and bear on axially opposed front surfaces and the two parts 236 and 238.

The outer tube 218 is fixed to the half-unit 238, which is preferably made of a metal which conducts electricity. The joining of the outer tube 218 to the half-unit 238 may be performed by brazing or by a flange (not shown). The half-unit 238 is provided with a recess 270 which flares out from the nozzle end of the outer tube 218 in the direction of the distributing unit 236 in order to define a nozzle end facing the distributing unit 236. It will be noted that the surface which delimits the recess 270 is preferably a surface of revolution which is tangential to the inner surface of the outer tube 218.

The inner tube 216 has, in the region of its end nozzle in the distributing unit 236, a slightly tapered end 282. A sleeve 254 is fitted onto this tapered end. This sleeve 254, which is made in a hard material having a high resistance to erosion by the pulverized coal, has substantially the shape of a bottleneck. It is positioned in the recess 270 so as to define an annular channel 272 which emerges virtually tangentially in the annular conduit 220 of the lance body 212. It will be noted that, by the cooperation of the surfaces delimiting the recess 270 and the sleeve 254, the annular channel 272 defines a passage cross-section which decreases steadily in the direction of the flow of the pulverized coal.

The distributing unit 236 is, in this embodiment, made of a dielectric material having a high hardness. It is, for example, a prismatic unit made of ceramic matter, for example, a ceramic material based on aluminum oxide. It presents a rear face 242 which bears, via a seal 286, on the rear of front plate 246. At the plate 246, this rear face 242 is provided with a cavity 243 which penetrates into the distributing half-unit 236. A front face 244 of the prismatic unit 236 bears on the half-unit 238 around the nozzle end of the recess 270 by means of a seal 288. In the axis of the inner tube 216, a blind central bore 252 emerges in the front face 244 of the prismatic unit 236. The diameter of this central bore 252 is slightly greater than the end 282 of the inner tube 216. The central bore 252 extends axially through the prismatic unit 236 as far as a lateral bore 256, which emerges in a lateral surface 255 of the prismatic unit 236. Around the central bore 252 two channels 254 are constructed which terminate, on the one hand, in the front cavity 243 and, on the other hand, in the annular channel 272 defined in the half-unit 238. The channels 254 are preferably symmetrical in relation to the central axis of the prismatic unit 236.

The inner tube 216 emerges with its end 282 in the central bore 252. A flange 290, rigidly attached to this end 282 of the inner tube 216, bears by means of a seal 292 on an end-piece 294 of the prismatic unit 236 which surrounds the central bore 252. The flange 290 consequently ensures a sealed closure of the central bore 252 around the inner tube 216. In addition, this flange 290 enables the inner tube 216 to be fixed and centered in the coupling device 214. For this purpose, it preferably has a square shape and is housed in a corresponding cavity of the half-unit 238. If the parts 236 and 238 are then joined axially, by tightening the bolts 280 for example, the inner tube 216 is locked between these half-units 236 and 238 by means of the flange 290. In the region of the end nozzle of the two channels 254, the flange 290 is provided with passage orifices bringing these channels 254 into communication with the annular channel 272. It will be noted that, between the flange 290 and the half-unit 238, there is disposed a dielectric material so as to prevent an electrical short-circuit between the inner tube 216, which is rigidly attached to the flange 290, and the outer tube 218 which is rigidly attached to the half-unit 238.

The prismatic unit 236 is disposed between two lateral plates 298 and 300. The plate 298 bears on the lateral surface 255 in which the second channel 256 emerges, whereas the plate 300 bears on an opposite lateral surface of the prismatic unit 236. The connector 232 for the gaseous oxidant is fitted into the plate 298. A seal 302 between the plate 298 and the prismatic unit 236 seals between the connector 232 and the second channel 256. The opposite plate 300 supports an electrical connector 304 enabling an electric potential to be applied to the inner tube 216. This electrical connector 304 comprises, for example, an insulating sleeve 306 which is mounted in a sealed manner in the plate 300 and an electrode 308 passing, preferably in a sealed manner, through the insulating sleeve 306 in order to penetrate through a channel 310 of the prismatic unit 236 into the central bore 252. In the central bore 252 the electrode 308 bears with its forward end on the inner tube 216. A seal 312 seals between the plate 300 and the prismatic unit 236. A spring 314 is arranged between the electrode 308 and a cap 316 screwed onto the sleeve 306 so as to maintain elastically the contact between the tip of the electrode 308 and the rear end 282 of the inner tube 216. The electrode 308 will preferably be connected to a positive terminal of a direct-current source, while the outer metal parts of the lance 210 (especially the outer tube 218, the forward half-unit 238, the plates 298, 300, etc.) are connected to the negative terminal of this source.

In this manner, it is possible to create an electrical field in the annular space 220 between the inner tube 216 and the outer tube 218. This electrical field has a positive influence on the reactivity of the coal particles which pass through the annular space 220 in suspension in an inert gas, (most often nitrogen). It is believed that this increase in the reactivity of the coal particles may be explained by the fact that the electric field prevents the molecules of the suspension gas from sticking on the coal particles and thus create a barrier for the reaction of these coal particles with the oxidant gas at the outlet of the lance 210. However, it is implicit that the value of the present invention is in no way dependent on the accuracy of the scientific explanation which has been given thereof.

It will also be noted that a deflector 320 is integrated in the forward end of the inner tube 216. This deflector 320, which preferably has a helical shape, has the purpose of promoting a rapid explosion of the jet of oxidant gas at the outlet of the inner tube 216.

Figure 5:
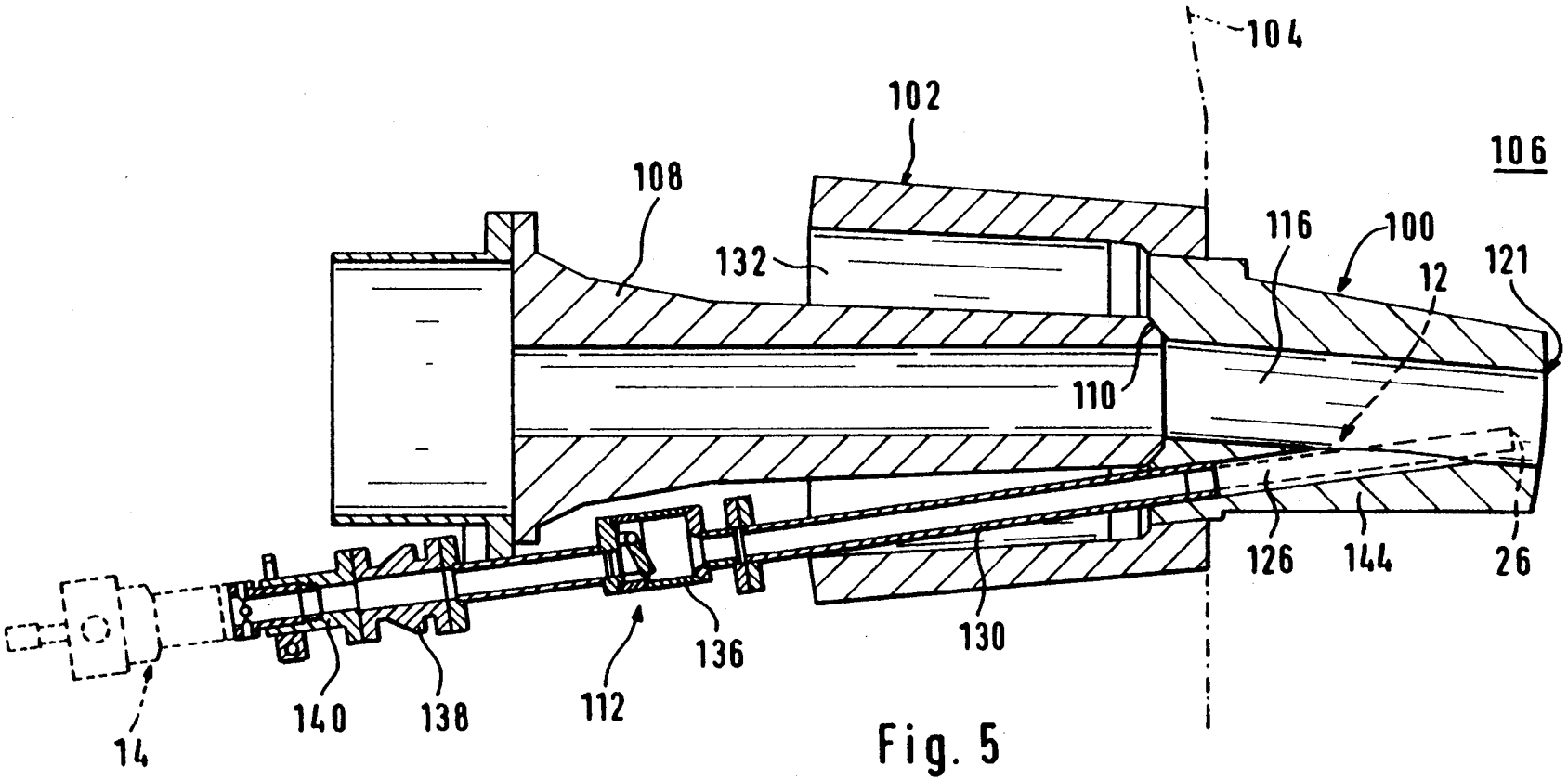
FIG. 5 shows a diagrammatic cross-section through a device for fitting the lance in accordance with the present invention into a hot-air blast tuyere, especially designed for this purpose.

FIG. 5 shows a hot-air blast tuyere 100 which is fitted in a manner known per se, with the aid of a tympe 112, into a wall 104 of a blast furnace. This tuyere emerges in the upper portion of a blast-furnace crucible 106. It constitutes the final conduit of a system of conduits constructed around the blast furnace in order to blow the hot-air blast into the crucible 106. A conduit 108, called a blast pipe, bears on the tuyere 100. The bearing surface between the blast pipe and the tuyere forms a ball-and-socket joint 110 which permits relative angular movement of the two conduits 100 and 108 in order to allow for relative angular deformations resulting from heat. The reference 112 designates overall a device for fitting a lance of the type described hereinabove. This device 112 in accordance with the present invention functions as follows. The end 26 of the lance 10 is introduced into the tuyere 100 so that the pulverized coal 20' and gaseous-oxidant 22' injection nozzles are located in the region of the nozzle end of the tuyere 100 in the crucible 106.

Figure 6:
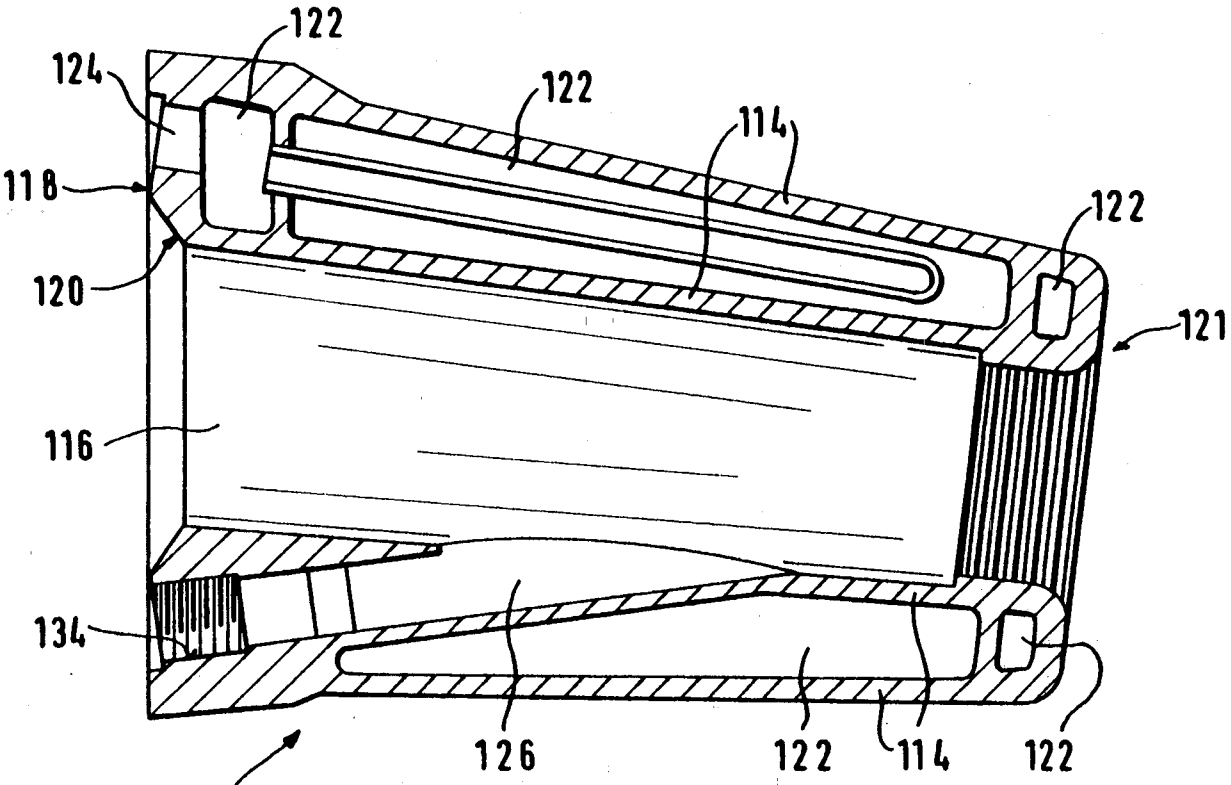
FIG. 6 shows a cross-section through a tuyere especially designed for fitting the lance device in accordance with the present invention.

FIG. 5 shows diagrammatically, in broken lines, the outline of the lance when the lance is fitted into the fitting device 112. This fitting device enables the lance body 12 to be introduced between the type 102 and the blast pipe 108, directly through a wall 114 of the tuyere 100, as far as the nozzle end of the tuyere 100 in the crucible 106. It will be noted that the tuyere 100 is a tuyere of novel design which is described with the aid of FIG. 6.

The tuyere 100 consists of a double wall 114 which forms, in a manner known per se, a frustoconical body defining axially a cylindrical hot-air blast conduit 116. In the region of the large base of the frustoconical body, the wall 114 forms an annular surface 118. The later is bounded around the nozzle end of the conduit 116 by an annular recess serving as a bearing surface for the blast pipe 108. In the region of the small base of the frustoconical body, the wall 114 defines the nozzle end 121 of the conduit 116 for the injection of the hot-air blast into the crucible 106. The double wall 114 defines inner cavities 112 which are connected to a cooling circuit. The reference 124 designates a connector for the inlet of a coolant fluid.

The tuyere 100 differs from a tuyere according to the prior art, by a straight channel 126 integrated into the double wall 114 of the tuyere and emerging on one side in the surface 118 at the upstream end of the tuyere, and on the other side in the hot-air blast conduit 116, so that the extension of the axis of the channel 126 in the direction of the nozzle end 121 of the tuyere does not encounter the wall 114 of the tuyere. The channel serves as a sheath for introducing the upstream end of the lance body 12 into the tuyere 100; it consequently has a passage cross-section slightly greater than the transverse cross-section of the forward end of the lance body 12.

On the side of the annular surface 118, this channel 126 is extended by a cylindrical sheath 130. The latter extends into an annular free space 132 available between the type 102 and the blast pipe 108. It is preferably screwed with one of its ends in the channel 126, which is provided with a thread 134 on the side of its nozzle end in the annular surface 118. At the other end, this sheath 130 is extended axially by a non-return valve 136, a ball valve 138 and a stuffing-box connector 140.

In order to fit the lance, it consequently suffices to open the ball valve 138 and insert the lance body through the stuffing-box connector 140 and the ball valve 138. The non-return valve 136, which prevents the hot gases from exiting when the valve 138 is open, is raised by the end 26 of the lance, while it is advanced in the direction of the sheath 130. When the coupling device of the lance 10 butts up against the stuffing-box connector 140 of the fitting device 112, it is certain that the injection nozzles 20' and 22' are precisely fitted into the hot-air blast conduit 116 at their intended location, that is to say in the region of the nozzle end 121 of the tuyere 100 in the crucible 106.

It will be appreciated that the protruding length of the lance body which is subjected to the flow of the hot-air blast is reduced to a minimum, and that the position of the end 26 of the lance 10 in the hot-air blast conduit 116 is no longer affected by a relative movement between the blast pipe 108 and the tuyere 100.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A lance device comprising:

a lance body including a first injection nozzle located at a first end of said lance body and a second injection nozzle disposed annularly around said first injection nozzle;

means for connecting said first injection nozzle to a circuit for supplying gaseous oxidant;

means for connecting said second injection nozzle to a circuit for supplying pulverized coal; and distributing means for distributing the pulverized coal and the gaseous oxidant, said distributing means being attached to a second end of said lance body, said second end being opposite from said first end.

2. The device of claim 1 wherein said lance body comprises:

an inner tube forming an inner conduit for the gaseous oxidant; and an outer tube surrounding the inner tube so as to define, with the inner tube, an annular conduit for the pulverized coal.

3. The device of claim 1 wherein said distributing means comprises:

a body;

a first coupling sleeve connected to said body and adapted for connection to a circuit for supplying pulverized coal in suspension in an inert gas;

a second coupling sleeve connected to said body and adapted for connection to a circuit for supplying a gaseous oxidant; and at least two first channels in said body connecting the first coupling sleeve to the said annular conduit; and at least one second channel in said body arranged between said first two channels in order to connect the second coupling sleeve to said inner conduit.

4. The device of claim 1 wherein said distributing means comprises:

a body:

two axially opposed surfaces on said body;

said lance body emerging through one of the said surfaces and said first coupling sleeve emerging in the extension of the axis of said lance body through the opposed surface into said distributing means;

a blind central bore in said body which axially extends said inner conduit in said distributing means;

an annular cavity axially extending said annular conduit in said distributing means;

at least two first channels in said body arranged symmetrically around said central bore and emerging on the one side in said annular cavity and on the other side in the said first coupling sleeve; and at least one second channel in said body arranged between said first channels and connecting said central bore to said second coupling sleeve.

5. The device of claim 4 wherein the free surface area of the annular transverse cross-section of said annular cavity decreases steadily from the nozzle end of said first channels in the direction of the nozzle end of said annular conduit.

6. The device of claim 4 wherein said outer tube includes a flange which is fixed to the surface of the distributing means through which flange said outer tube emerges in the distributing means.

7. The device of claim 4 wherein said distributing means includes a plurality of second channels distributed around said central channel and emerging in an annular peripheral chamber surrounding said distributing unit over a portion of its length, and wherein said second coupling sleeve emerges in said annular peripheral chamber.

8. The device of claim 4 wherein said first coupling sleeve emerges in a cavity of the distributing means facing a rounded deflection surface.

9. The device of claim 4 wherein:

said distributing device is composed of two half-units joined along the axis of the lance body;

the first half-unit including said coupling sleeves, said first and second channels and an axial extension located on the opposite side of the first coupling sleeve, said inner tube being connected to the free end of said axial extension and said axial extension passing through said central bore and being surrounded at its base by a surface in which said first channels emerge;

the second half-unit including an axial bore serving as a seat for said outer tube and a recess axially extending, flaring out, the conduit formed by the outer tube; and said recess cooperating with said axial extension in order to form said annular cavity during the joining of the two half-units.

10. The device of claim 2 including:

means for electrically insulating said inner tube from said outer tube; and means for applying a potential difference between the outer tube and the inner tube and thus creating an electrical field in said annular channel.

11. The device of claim 10 including means for distributing pulverized coal and the gaseous oxidant comprising a distributing unit, said distributing unit comprising a hard dielectric material.

12. The device of claim 11 wherein said distributing unit is a prismatic unit, having a first and second base and a plurality of lateral surfaces, which further comprises:

a blind central bore in said first base in order to receive one end of said inner tube;

a cavity emerging in said second base;

channels surrounding said central bore and extending said cavity in order to emerge in said first base;

a first lateral bore located between said channels, so as to define a nozzle end in a first lateral surface and to emerge in said central bore; and a second lateral bore located between said channels so as to define a nozzle end in a second lateral surface and to emerge in said central bore.

13. The device of claim 12 wherein said distributing device further comprises:

a first front plate which bears on said second base of said prismatic unit and which supports, in the extension of said cavity a coupling sleeve for the pulverized coal;

a forward half-unit which supports said outer tube and which bears on the said first base of said prismatic unit;

a first lateral plate which bears on said first lateral surface of said prismatic unit and which supports, in extension of the said first lateral bore, a coupling sleeve for the gaseous oxidant; and a second lateral plate which bears on said second lateral surface of said prismatic unit and which supports, in extension of said second lateral bore, an electrode penetrating through said second lateral bore into said central bore.

14. The device of claim 13 wherein said distributing device further comprises bolts which connect said forward half-unit to said first front plate.

15. The device of claim 13 wherein the inner tube includes a flange which is housed axially between said distributing unit and said forward half-unit and which is locked therein by the axial joining of the distributing unit to the forward half-unit.

16. The device of claim 15 wherein the inner tube includes, in the region of its nozzle end in the distributing unit, with a sleeve having substantially the shape of a bottleneck which, after joining the lance is positioned in said recess of the forward half-unit so as to define an annular channel which emerges substantially tangentially in said annular conduit of the lance body.

17. The device of claim 15 wherein said first injection nozzle is provided with a helical deflector.

18. A lance for the combined injection of pulverized coal and a gaseous oxidant into a shaft furnace, comprising:

a lance body including an inner tube forming an inner conduit for the gaseous oxidant and an outer tube surrounding the inner tube so as to define, between the inner tube and the outer tube, an annular conduit for the pulverized coal, said lance body having a nozzle end and a rear end;

distributing means for distributing the pulverized coal and the gaseous oxidant, said distributing means being attached to the rear end of said lance body, including:

a body;

a first coupling sleeve connected to said body and adapted for connection to a circuit for supplying pulverized coal, said first coupling sleeve being arranged in axial alignment with said lance body;

a second coupling sleeve connected to said body and adapted for connection to a circuit for supplying a gaseous oxidant;

at least two first channels in said body axially opening into said annular conduit;

splitting means connected between said first coupling sleeve and said first channels for splitting a pulverized coal stream flowing through said first coupling sleeve among said first channels;

at least one second channel in said body connecting said second coupling sleeve to said inner conduit by passing between two of said first channels.

19. A device for the injection of pulverized coal and a gaseous oxidant into a blast-furnace crucible comprising:

a blast tuyere for mounting in a wall of a blast furnace, said blast tuyere having a nozzle end, a hot-air blast conduit opening in said nozzle end of the blast tuyere and defining therein an outlet section, a double wall surrounding said hot-air blast conduit, and a straight passage sheath through said double wall; said straight passage sheath opening obliquely in said hot-air blast conduit; and a lance for the combined injection of fuel and a gaseous oxidant, said lance having a straight tubular body, said tubular body having a nozzle end;

said lance being removably mounted in said tuyere with said straight tubular body of said lance passing through said straight passage sheath of said tuyere so that said nozzle end of said lance tubular body is in said blast conduit in the vicinity of said outlet section.

* * * * *